US007762350B2

(12) United States Patent
Hartwig

(10) Patent No.: US 7,762,350 B2
(45) Date of Patent: Jul. 27, 2010

(54) IMPULSE GENERATOR AND IMPULSE TOOL WITH IMPULSE GENERATOR

(75) Inventor: Sverker Hartwig, Täby (SE)

(73) Assignee: Atlas Copco Rock Drills AB, Orebro (SE)

( * ) Notice: Subject to any disclaimer, the term of this patent is extended or adjusted under 35 U.S.C. 154(b) by 65 days.

(21) Appl. No.: 11/918,702

(22) PCT Filed: May 19, 2006

(86) PCT No.: PCT/SE2006/000582

§ 371 (c)(1),
(2), (4) Date: Oct. 17, 2007

(87) PCT Pub. No.: WO2006/126934

PCT Pub. Date: Nov. 30, 2006

(65) Prior Publication Data

US 2009/0065230 A1 Mar. 12, 2009

(30) Foreign Application Priority Data

May 23, 2005 (SE) ..... 0501152

(51) Int. Cl.
*B25D 9/12* (2006.01)

(52) U.S. Cl. ..... 173/208; 173/206; 173/207

(58) Field of Classification Search ..... 173/208, 173/206, 207

See application file for complete search history.

(56) References Cited

U.S. PATENT DOCUMENTS

| | | | | |
|---|---|---|---|---|
| 879,971 | A * | 2/1908 | Locke | 175/212 |
| 3,570,609 | A * | 3/1971 | Wise | 173/126 |
| 3,583,498 | A * | 6/1971 | Dorm | 173/204 |
| 3,605,555 | A | 9/1971 | Wise | |
| 4,159,039 | A | 6/1979 | Kasuga et al. | |
| 5,222,425 | A | 6/1993 | Davies | |
| 5,549,252 | A | 8/1996 | Walter | |
| 6,112,832 | A | 9/2000 | Muuttonen et al. | |
| 7,013,996 | B2 * | 3/2006 | Keskiniva et al. | 175/135 |
| 7,252,154 | B2 * | 8/2007 | Keskiniva et al. | 173/91 |
| 7,322,425 | B2 * | 1/2008 | Keskiniva et al. | 173/1 |
| 7,441,608 | B2 * | 10/2008 | Keskiniva et al. | 173/91 |
| 2004/0226752 | A1 * | 11/2004 | Keskiniva et al. | 175/135 |
| 2005/0139368 | A1 * | 6/2005 | Keskiniva et al. | 173/206 |

FOREIGN PATENT DOCUMENTS

| | | |
|---|---|---|
| GB | 329921 | 5/1930 |
| GB | 1142172 | 2/1969 |
| GB | 2047794 | 12/1980 |

(Continued)

*Primary Examiner*—Brian D Nash
(74) *Attorney, Agent, or Firm*—Mark P. Stone

(57) ABSTRACT

The invention relates to an impulse generator (2) for a rock breaking tool, which comprises a propulsion chamber (6) for receiving a pressurizeable liquid volume (8), and an in the propulsion chamber (6) received impulse piston (10), where the impulse piston (10) is arranged for transfer of pressure peaks in the liquid volume (8) into impulses in the tool (12), whereby transfer of energy from a propulsion mechanism (14) into impulses in the tool (12) is effected by volume reduction of the propulsion chamber (6), whereby the impulse piston (10) is driven forward by a pressure peak in the propulsion chamber (6). The invention also relates to a hydraulic impulse tool comprising an impulse generator (2).

39 Claims, 4 Drawing Sheets

FOREIGN PATENT DOCUMENTS

| | | |
|---|---|---|
| WO | WO 96/19323 | 6/1996 |
| WO | 03004822 | 1/2003 |
| WO | WO 03/033873 | 4/2003 |
| WO | 03095153 | 11/2003 |
| WO | WO 2004/073930 | 9/2004 |
| WO | WO 2004/073931 | 9/2004 |
| WO | WO 2004/073932 | 9/2004 |
| WO | WO 2004/073933 | 9/2004 |
| WO | WO 2005/ 002801 | 1/2005 |
| WO | WO 2005/002802 | 1/2005 |
| WO | 2005080051 | 9/2005 |

* cited by examiner

IMPULSE GENERATOR AND IMPULSE TOOL WITH IMPULSE GENERATOR

TECHNICAL FIELD

The present invention relates to an impulse generator for a rock breaking tool, and an impulse tool with impulse generator.

BACKGROUND

In traditional rock breaking tools a piston which pneumatically or hydraulically is made to move back and forth in a cylinder is used, where the piston strikes directly or indirectly via for example a drill steel shank against the end of a drilling steel which in turn strikes the rock. By that the piston, which has a relatively large mass, moves quickly towards the drilling steel unwanted dynamic acceleration forces arise in the drilling rig which strive to pull the drilling steel away from the rock.

In order to decrease the above mentioned dynamic acceleration forces efforts have been made with rock breaking tools which contrary to the traditional rock breaking tools have a piston that does not move as far back and forth in the cylinder during transfer of the impact force which also brings about a possibility to increase the impact frequency.

GB 2 047 794 A shows a rock breaking tool where a piston is pretensioned by that it is moved in a direction away from the drill steel at the same time as a pressure is built up in an energy storing space on the side of the piston opposite to the drill steel side. By that then abruptly releasing the piston, the pressure in the energy storing space forces the piston towards the drill steel with a high velocity whereby a stress pulse strikes the drill steel.

WO 03/095153 A1 shows another rock breaking tool where a piston is pretensioned by that it is moved in a direction away from the drill steel at the same time as a pressure is built up in an energy storing space on the side of the piston opposite to the drill steel side. By that then abruptly releasing the piston, the pressure in the energy storing space forces the piston towards the drill steel with a high velocity whereby a stress pulse strikes the drill steel.

US 2004/0226752 shows yet another rock breaking tool where a piston is pretensioned by that it is moved in a direction away from the drill steel at the same time as a pressure is built up in an energy storing space on the side of the piston opposite to the drill steel side. The energy storing space is in this case a metal rod. By that then abruptly releasing the piston, the pressure in the energy storing space forces the piston towards the drill steel with a high velocity whereby a stress pulse strikes the drill steel.

BRIEF DESCRIPTION OF THE INVENTION

The problem with the occurrence of large dynamic acceleration forces is solved according to the invention by arranging an impulse generator for a rock breaking tool which comprises a propulsion chamber for receiving a pressurizeable fluid volume, and an in the propulsion chamber received impulse piston, where the impulse piston is arranged for transfer of pressure peaks in the fluid volume into impulses in the tool, whereby transfer of energy from a propulsion mechanism into impulses in the tool is effected by volume reduction of the propulsion chamber, whereby the impulse piston is driven forward by a pressure peak in the propulsion chamber.

By that the impulse generator comprises the characteristics in claim 1, the advantage of bringing about an impulse generator which may transfer impulses into a tool with low dynamic acceleration forces is attained.

BRIEF DESCRIPTION OF DRAWINGS

The invention will be described below in greater detail with reference to the attached drawings, in which.

DESCRIPTION OF PREFERRED EMBODIMENTS

Figure 1:
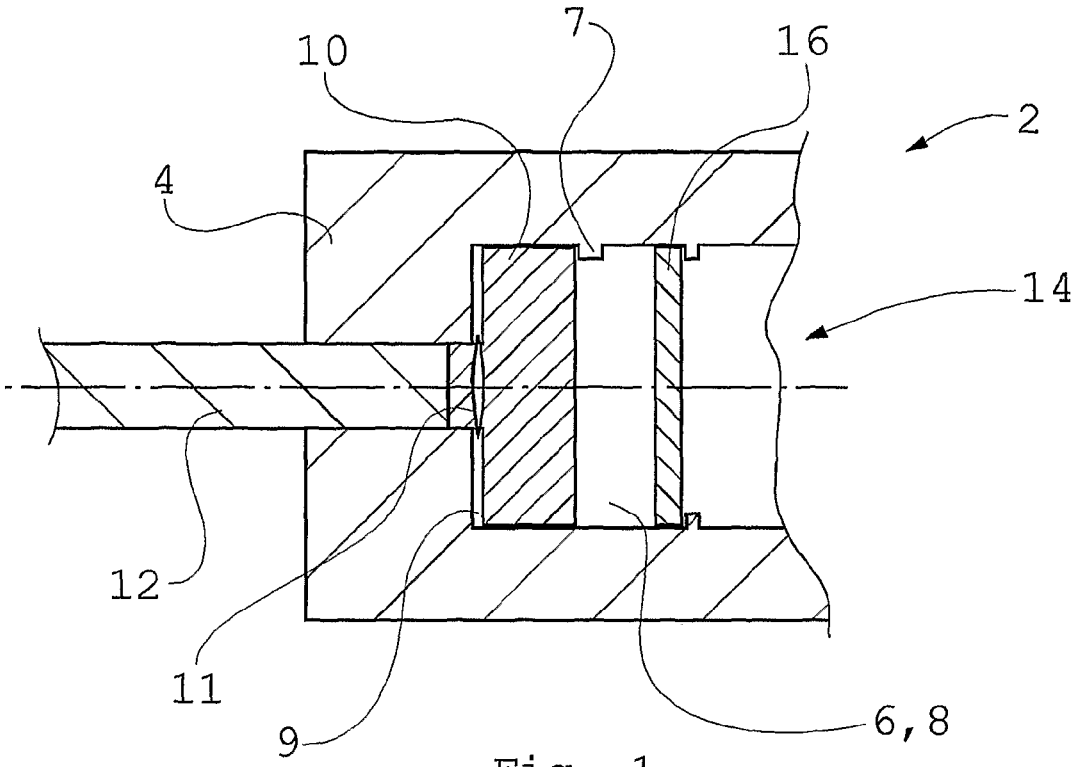
FIG. 1 shows schematically a longitudinal section of a first embodiment of an impulse generator.

FIG. 1 shows schematically a longitudinal section of a first embodiment of an impulse generator 2 comprising a housing 4 with a propulsion chamber 6 for receiving a pressurizeable fluid volume 8, and an in the propulsion chamber 6 received impulse piston 10, where the impulse piston 10 is arranged for direct or indirect transfer of pressure peaks in the fluid volume 8 into impulses in a tool 12, whereby transfer of energy from a propulsion mechanism 14 into impulses in the tool 12 is effected by volume reduction of the propulsion chamber 6, whereby the impulse piston 10 is driven forward by a pressure peak in the propulsion chamber 6. If the impulse piston 10 is arranged adjacent to the tool 12, the impulses are transferred directly, but the impulses may also be transferred indirectly via for example an intermediate drill steel shank (not shown). In the figure, the propulsion chamber 6 is shown in a position where the pressure in the fluid volume 8 in the propulsion chamber 6 is so low that the impulse piston 10 is situated in its first end position, i.e. the end position located at the maximum distance from the tool 12. In this position, the propulsion chamber 6 is expanded as much as possible, preferably by that a piston 16 in the propulsion chamber 6 in a piston-chamber device is at the mentioned end position where the volume of the propulsion chamber 6 is as large as possible. The piston-chamber device may also comprise more than one piston 16 in the propulsion chamber 6. The return movement of the impulse piston 10 to this shown position is effected e.g. by pressurizing a chamber 9 on the side of the impulse piston 10 opposite the side of the propulsion chamber 6 with air or fluid or by arranging a spring 11 in this space, or by moving the whole drilling rig with the thereon mounted impulse generator 2 forward against the rock in which case a shoulder 7 should be arranged as a stop in the propulsion chamber 6.

Figure 2:
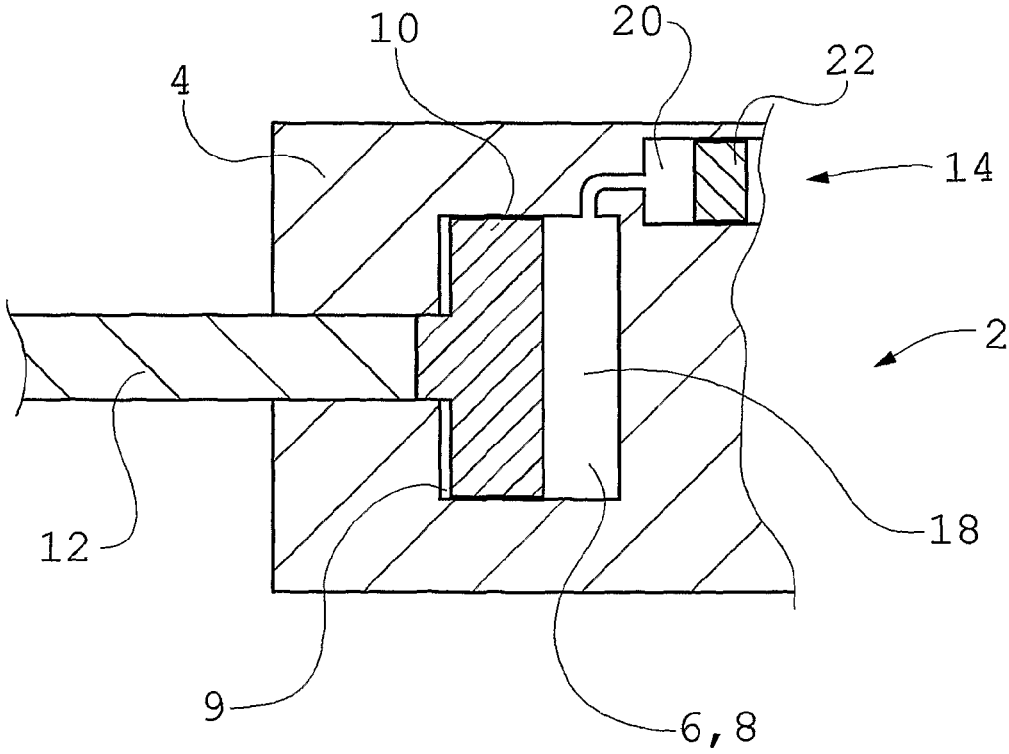
FIG. 2 shows schematically a longitudinal section of a second embodiment of an impulse generator.

FIG. 2 shows schematically a longitudinal section of a second embodiment of an impulse generator 2 comprising a housing 4 with a propulsion chamber 6 for receiving a pressurizeable fluid volume 8, and an in the propulsion chamber 6 received impulse piston 10, where the impulse piston 10 is arranged for direct or indirect transfer of pressure peaks in the fluid volume 8 into impulses in a tool 12. The propulsion chamber 6 comprises a main chamber 18 and at least one to the main chamber 18 connected side chamber 20. The impulse piston 10 is in this case situated in the main chamber 18. Transfer of energy from a propulsion mechanism 14 into impulses in the tool 12 is effected by volume reduction of the side chamber 20, and thus the propulsion chamber 6, whereby the impulse piston 10 is driven forward by a pressure peak in the propulsion chamber 6. In the figure, the propulsion chamber 6 is shown in a position where the pressure in the fluid volume 8 in the propulsion chamber 6 is so low that the impulse piston 10 is situated at its first end position, i.e. the end position situated at the maximum distance from the tool 12. In this position, the propulsion chamber 6 is expanded as much as possible, preferably by that a piston 22 in the side chamber 20 in a piston-chamber device is at the mentioned end position where the volume of the side chamber 20 is as large as possible.

Figure 3:
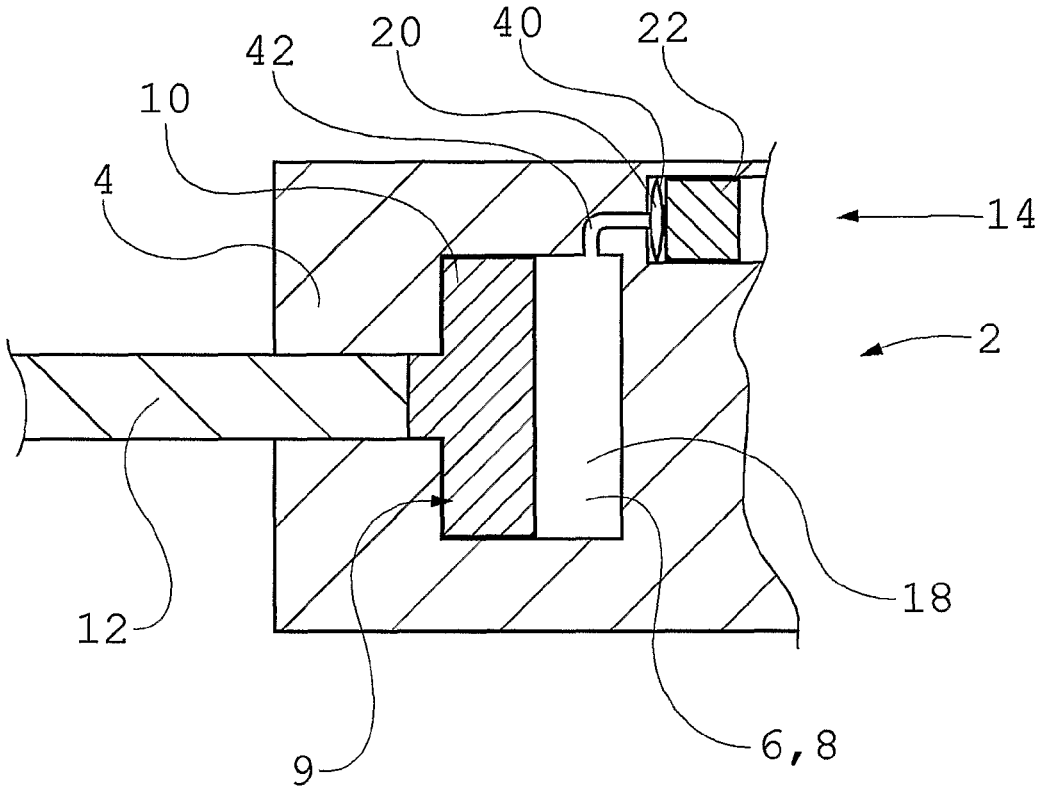
FIG. 3 shows schematically a longitudinal section of an impulse generator 2 according to FIG. 2.

FIG. 3 shows schematically a longitudinal section of an impulse generator 2 according to FIG. 2 where the propulsion chamber 6 is in a position where the pressure in the fluid volume 8 in the propulsion chamber 6 is so high that the impulse piston 10 is situated at its second end position, i.e. the end position situated at the minimum distance from the tool 12. In this position, the propulsion chamber 6 is compressed, preferably by that a piston 22 in the side chamber 20 in a piston-chamber device is at the mentioned end position where the volume of the side chamber 20 is as small as possible, whereby the impulse piston 10 transfers a pressure peak in the fluid volume 8 into an impulse in the tool 12. The piston 22 in the side chamber 20 and the impulse piston 10 in the main chamber 18 preferably have matched draining holes and/or draining channels (not shown) of known type for cooling and lubrication.

The propulsion chamber 6 is preferably adapted for a frequency of between about 400 and 1000 Hz and has preferably an applied static base pressure for pressing out the piston 22 in the side chamber 20 in the direction away from the main chamber 18. Optionally, prestressed springs 40 may be arranged to press out the piston 22 in the side chamber 20 in the direction away from the main chamber 18. The propulsion chamber 6 is preferably adapted for that in the fluid volume shall be received fluid from the group: water, silicone oil, hydraulic oil, mineral oil, and non-combustible hydraulic fluid. The main chamber 18 has preferably a circular cross-section and may be connected to a side chamber 20 via at least one fluid channel 42 or optionally the chambers 18,20 may be in direct contact with each other.

Figure 4:
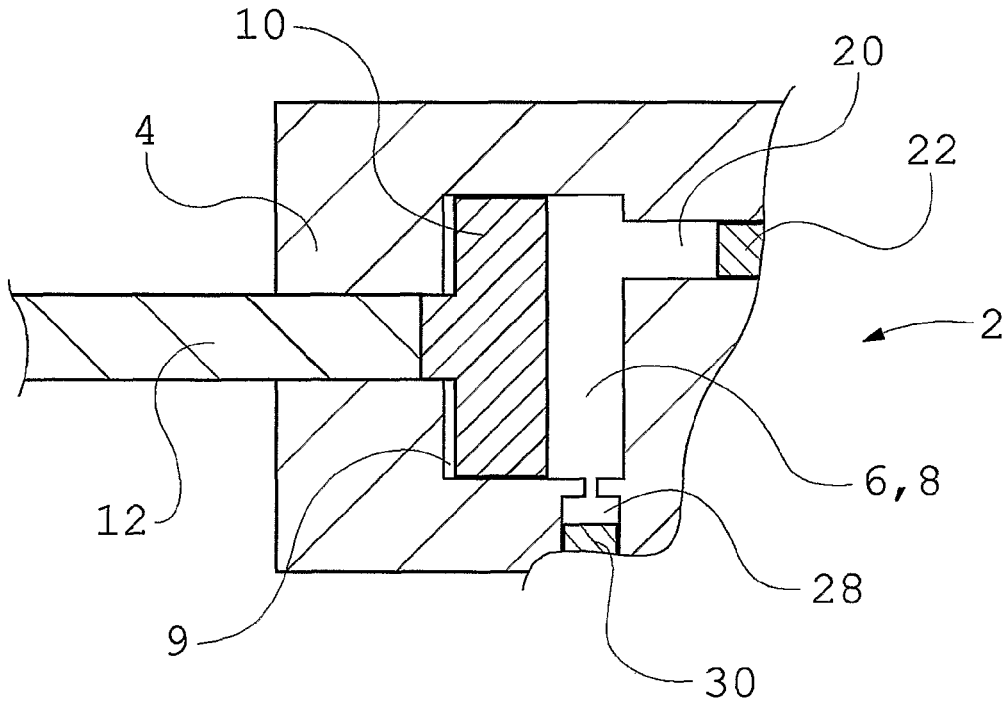
FIG. 4 shows schematically a longitudinal section of a third embodiment of an impulse generator according to the invention.

FIG. 4 shows schematically a longitudinal section of a third embodiment of an impulse generator according to the invention. This embodiment differs from the one shown in FIG. 2 in that the propulsion chamber 6 comprises two side chambers 20,28. In the figure, the propulsion chamber 6 is shown in a position where the propulsion chamber 6 is expanded as much as possible, preferably by that a piston 22,30 in each side chamber 20,28 is at the end position where the volume of both side chambers 20,28 is as large as possible. The piston 22,30 in a side chamber 20,28 may move either axially relative to the tool 12 (see the piston 22), radially relative to the tool 12 (see the piston 30), or along a line which is tilted relative to the tool.

Figure 5:
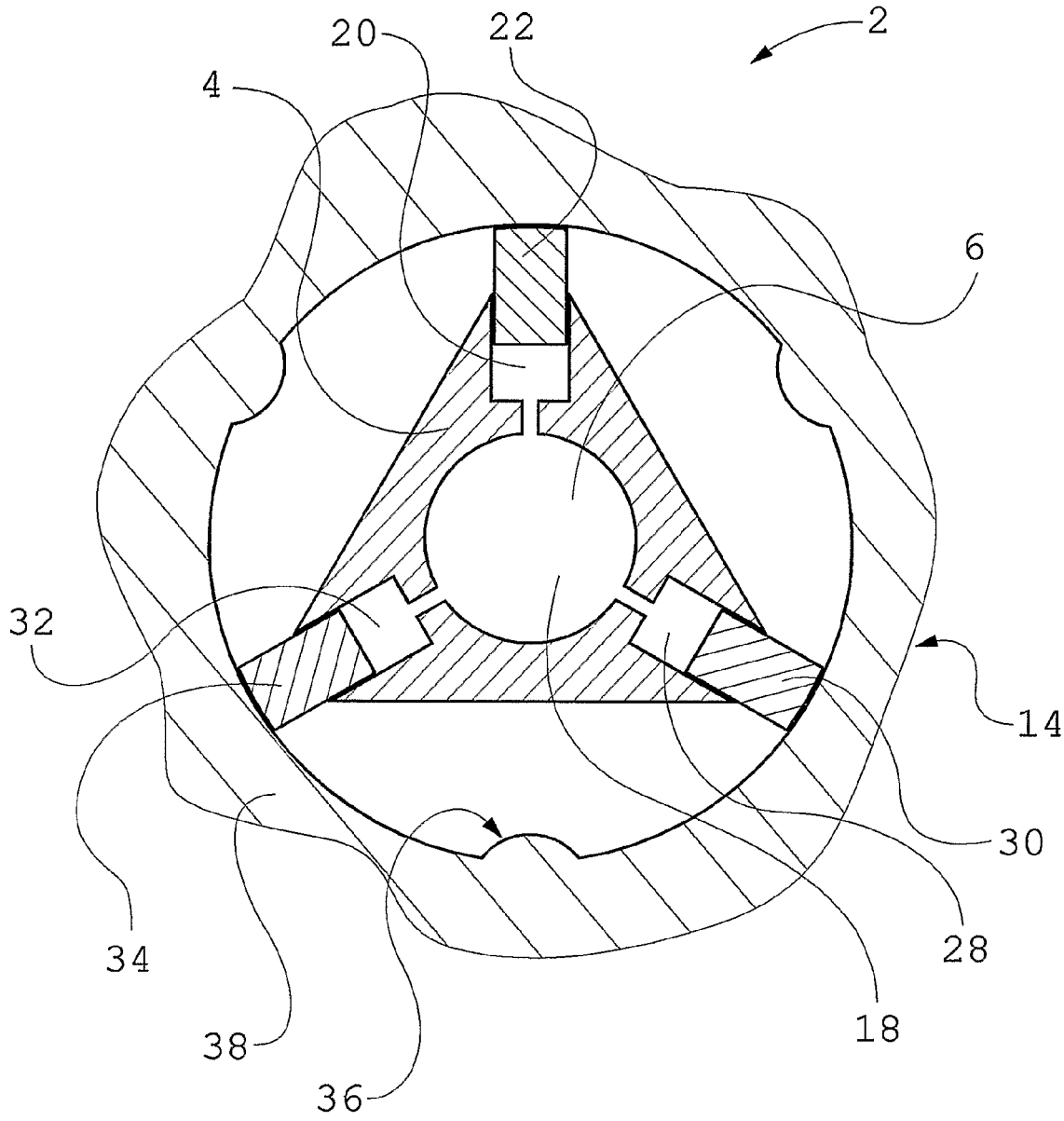
FIG. 5 shows schematically a cross-section of a fourth embodiment of an impulse generator according to the invention, FIG. 6*a* schematically illustrates an internal conical cam surface for use in the embodiment of the impulse generator illustrated by FIG. 5, and FIG. 6*b* schematically illustrates an external conical cam surface for use in the embodiment of the impulse generator illustrated by FIG. 5.

FIG. 5 shows schematically a cross-section of a fourth embodiment of an impulse generator according to the invention. This embodiment differs from the one shown in FIG. 2 by that the propulsion chamber 6 comprises three side chambers 20,28,32 with respective pistons 22,30,34, where the side chambers 20,28,32 are distributed over the circumference of the main chamber 18. Of course, the propulsion chamber 6 may also comprise more than three side chambers 20,28,32, distributed either symmetrically or non-symmetrically over the circumference of the main chamber 18. The impulse generator may be designed to be rotationally driven with e.g. a cam-follower-arrangement where the piston 22,30, 34 runs against a cam curve path 36 of a cam disk 38, where the cam curve path may be either internal or external.

Figure 6A:
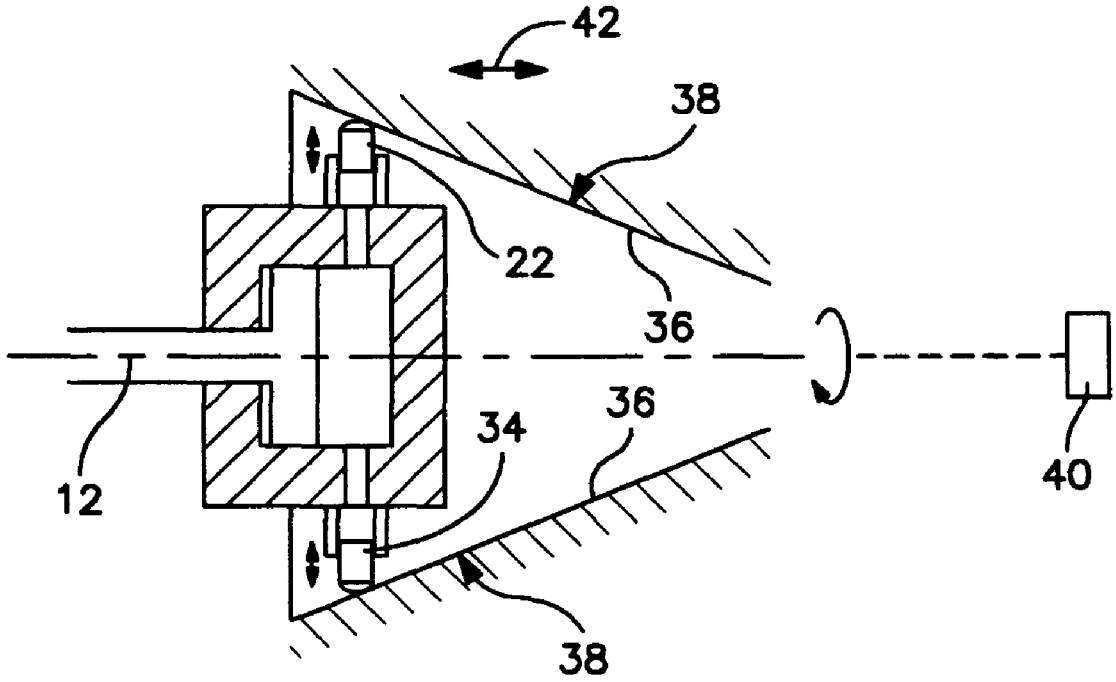
Figure 6B:
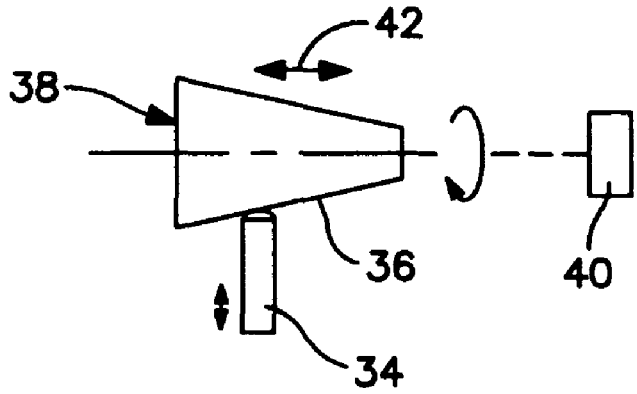

The cam curve path may be straight or conical and the same or different for each piston. FIG. 6*a* schematically illustrates an internal conical curve path, and FIG. 6*b* illustrates an external conical curve path. The cam curve path for all pistons are preferably synchronized so that all pistons move synchronously relative to the main chamber. The cam disk of the impulse generator may be driven by a separate motor, illustrated by reference numeral 40 in FIGS. 6*a* and 6*b*, and the force that drives the cam disk of the impulse generator is generated mechanically, hydraulically or electrically. Further, the moment of inertia of the cam disk may be used to balance the flow of energy. The movement of the pistons may be forcedly guided by the cam curve of the cam disk regarding both their ingoing and outgoing movements. The cam disk may as an option be displaced axially relative to the tool , as designated by arrows 42 in FIGS. 6*a* and 6*b*, so that the pistons which run against the cam curve of the cam disk meet different cam geometry depending on the axial position of the cam disk. The cam disk may as another option be displaced axially relative to the tool , as designated by arrows 42 in FIGS. 6*a* and 6*b*, so that the pistons which run against the cam curve of the cam disk meet a different number of cams per revolution depending on the axial position of the cam disk. The cam disk may also comprise more than one against each other arranged disk elements that may be turned relative to each other to change the geometry of the cam disk whereby a variable cam curve may be generated. Preferably, the cam disk may be manually or automatically axially displaced relative to the tool during operation. The cam disk may moreover be arranged to be exchangeable whereby the characteristics of the impulse generator may be adapted to the drilling conditions. The cam disk may further be arranged with non-symmetrical geometry so that the impulse generator obtains different characteristics depending on in which direction the cam disk is rotated. The rotation of the cam disk, directly or via a gear mechanism, may be used to rotate the tool. The drive of the impulse generator may also be designed as a radial piston engine.

It is possible to combine that which has been mentioned in the different herein described optional embodiments within the scope of the following claims.

The invention claimed is:

1. Impulse generator for a rock breaking tool, the impulse generator (2) comprising a propulsion chamber (6) for receiving a pressurizable liquid volume (8), and an impulse piston (10) received in the propulsion chamber (6), wherein the impulse piston (10) is arranged for transfer of pressure peaks in the liquid volume (8) into impulses in the tool (12), and at least one propulsion mechanism (14) comprising a piston (16, 22, 30, 34) arranged movable within the propulsion chamber (6) for volume reduction of the propulsion chamber (6) and thereby volume reduction of the pressurizable liquid contained in the propulsion chamber (6) so as to generate a pressure peak in said pressurizable liquid, whereby transfer of energy into impulses in the tool (12) is effected by the impulse piston (10) being driven forward by said pressure peak in said pressurizable liquid in the propulsion chamber (6).

2. Impulse generator as claimed in claim 1, characterized in, that the impulse generator (2) comprises a piston-chamber device (16, 22, 30, 34; 6, 20, 28, 32) having at least one piston received in at least one chamber, whereby a movement of said at least one piston (16, 22, 30, 34) in said at least one chamber (6, 20, 28, 32) effects the volume reduction of the propulsion chamber (6).

3. Impulse generator as claimed in claim 2, characterized in, that the piston-chamber device (16, 22, 30, 34; 6, 20, 28, 32) comprises more than one piston (16, 22, 30, 34).

4. Impulse generator as claimed in claim 2, characterized in, that the piston-chamber device is a piston-cylinder device (16, 22, 30, 34; 6, 20, 28, 32).

5. Impulse generator as claimed in claim 2, characterized in, that said at least one piston (22, 30, 34) of said piston-chamber device engages a cam curve path (36) of a cam disk (38).

6. Impulse generator as claimed in claim 5, characterized in, that the cam curve path (36) is internal or external.

7. Impulse generator as claimed in claim 6, characterized in, that said at least one piston of said piston-chamber device engages a conical cam curve path (36).

8. Impulse generator as claimed in claim 5, characterized in, that said at least one piston of said piston-chamber device engages a conical cam curve path (36).

9. Impulse generator as claimed in claim 5, characterized in, that the cam curve paths (36) are the same for each said piston (16, 22, 30, 34) of said piston-chamber device.

10. Impulse generator as claimed in claim 5, characterized in, that the cam curve paths (36) for all said pistons (16, 22, 30, 34) of said piston-chamber device are synchronized, whereby all pistons (16, 22, 30, 34) move synchronously relative to the main chamber (18).

11. Impulse generator as claimed in claim 5, characterized in, that the cam disk (38) of the impulse generator (2) is driven by a separate motor.

12. Impulse generator as claimed in claim 11, characterized in, that the force which drives the cam disk (38) of the impulse generator (2) is generated mechanically, hydraulically or electronically.

13. Impulse generator as claimed in claim 5, characterized in, that the moment of inertia of the cam disk (38) is used to balance the flow of energy.

14. Impulse generator as claimed in claim 5, characterized in, that the pistons (16, 22, 30, 34) of said piston-chamber device are forcedly guided by the cam curve (36) of the cam disk (38) for both ingoing and outgoing movements of said pistons.

15. Impulse generator as claimed in claim 5, characterized in, that the cam disk (38) is axially displaceable relative to the tool (12) so that the pistons (16, 22, 30, 34) of said piston-chamber device that engage the cam curve (36) of the cam disk (38) meet different cam geometry depending on the axial position of the cam disk (38).

16. Impulse generator as claimed in claim 5, characterized in, that the cam disk (38) is axially displaced relative to the tool (12) so that the pistons (16, 22, 30, 34) of said piston-chamber device which engage the cam curve (36) of the cam disk (38) meet a different number of cams per revolution depending on the axial position of the cam disk (38).

17. Impulse generator as claimed in claim 5, characterized in, that the cam disk (38) comprises a plurality of disk elements arranged against each other and turnable relative to each other for changing the geometry of the disk (38) whereby a variable cam curve (36) can be generated.

18. Impulse generator as claimed in claim 5, characterized in, that the cam disk (38) is axially displaceable, manually or automatically, relative to the tool (12) during operation.

19. Impulse generator as claimed in claim 5, characterized in, that cam disk (38) is arranged exchangeable whereby the characteristics of the impulse generator (2) may be adapted to the drilling conditions.

20. Impulse generator as claimed in claim 5, characterized in, that the impulse generator (2) obtains different characteristics depending on the direction in which the cam disk (38) is rotated.

21. Impulse generator as claimed in claim 5, characterized in, that the rotation of the cam disk (38), directly or via a gear mechanism, is used to rotate the tool (12).

22. Impulse generator as claimed in claim 1, characterized in, that the propulsion chamber (6) comprises a main chamber (18) in which the impulse piston (10) is situated, and at least one side, chamber (20, 28, 32) connected to the main chamber (18), whereby transfer of energy from said propulsion mechanism (14) to impulses in the tool (12) is effected by volume reduction of the side chamber (20), whereby the impulse piston (10) is driven forward by a pressure peak in the propulsion chamber (6).

23. Impulse generator as claimed in claim 22, characterized in, that a piston (22) is received in at least one said side chamber (20), and the piston (22) in said at least one side chamber (20) moves axially relative to the tool (12).

24. Impulse generator as claimed in claim 23, characterized in, that a second said piston (30) in a second said side chamber (28) moves radially relative to the tool (12).

25. Impulse generator as claimed in claim 22, characterized in, that a piston (30) is received in said at least one side chamber (28), and the piston (30) in said at least one side chamber (28) moves radially relative to the tool (12).

26. Impulse generator as claimed in claim 22, characterized in, that a piston is received in said at least one side chamber, and the piston in said at least one side chamber moves along a line which is tilted relative to the tool.

27. Impulse generator as claimed in claim 22, characterized in, that a prestressed spring (40) is arranged to force a piston (22, 30, 34) in said at least one side chamber (20, 28, 32) in a direction away from the main chamber (18).

28. Impulse generator as claimed in claim 22, characterized in, that the main chamber (18) is connected to at least one said side chamber (20, 28, 32) via at least one fluid channel (42).

29. Impulse generator as claimed in claim 22, characterized in, that the main chamber (18) and at least one said side chamber (20, 28, 32) are in direct contact with each other.

30. Impulse generator as claimed in claim 1, including means for rotationally driving the impulse generator.

31. Impulse generator as claimed in claim 30, characterized in, that said means for rotationally driving the impulse generator includes a cam-follower-arrangement (38; 22, 30, 34).

32. Impulse generator as claimed in claim 1, characterized in, that the drive of the impulse generator (2) is designed as a radial piston engine.

33. Impulse generator as claimed in claim 1, characterized in, that a plurality of side chambers (20, 28, 32) are distributed over the circumference of the main chamber (18).

34. Impulse generator as claimed in claim 1, characterized in, that the main chamber (18) has a circular cross-section.

35. Impulse generator as claimed in claim 1, characterized in, that the propulsion chamber (6) is adapted to a frequency of between about 400 and 1000 Hz.

36. Impulse generator as claimed in claim 1, characterized in, that said impulse generator includes at least one propulsion piston (16, 22, 30, 34), and said at least one propulsion piston and the impulse piston (10) have matched draining holes and/or draining channels for cooling and lubrication.

37. Impulse generator as claimed in claim 1, characterized in, that the propulsion chamber (6) has an applied static base pressure.

38. Impulse generator as claimed in claim 1, characterized in, that the pressurizable liquid in the propulsion chamber (6) is selected from the group of: water, silicone oil, hydraulic oil, mineral oil, and non-combustible hydraulic fluid.

39. A hydraulic impulse tool, chararacterized in that it comprises an impulse generator (2), the impulse generator (2) comprising a propulsion chamber (6) for receiving a pressurizable liquid volume (8), and an impulse piston (10) received in the propulsion chamber (6), wherein the impulse piston (10) is arranged for transfer of pressure peaks in the liquid volume (8) into impulses in the tool (12), and at least one propulsion mechanism (14) comprising a piston (16, 22, 30, 34) arranged movable within the propulsion chamber (6) for volume reduction of the propulsion chamber (6) and thereby volume reduction of the pressurizable liquid contained in the propulsion chamber (6) so as to generate a pressure peak in said pressurizable liquid, whereby transfer of energy into impulses in the tool (12) is effected by the impulse piston (10) being driven forward by said pressure peak in said pressurizable liquid in the propulsion chamber (6).

* * * * *